US009694485B1

(12) United States Patent
Mellin et al.

(10) Patent No.: US 9,694,485 B1
(45) Date of Patent: Jul. 4, 2017

(54) GRIP SUPPORT DEVICE AND METHOD OF USE

(71) Applicants: Kerry Mellin, Simi Valley, CA (US); Merrily Mellin, Simi Valley, CA (US); Wendy Mellin, Simi Valley, CA (US)

(72) Inventors: Kerry Mellin, Simi Valley, CA (US); Merrily Mellin, Simi Valley, CA (US); Wendy Mellin, Simi Valley, CA (US)

( * ) Notice: Subject to any disclaimer, the term of this patent is extended or adjusted under 35 U.S.C. 154(b) by 0 days.

(21) Appl. No.: 15/283,879

(22) Filed: Oct. 3, 2016

Related U.S. Application Data

(63) Continuation of application No. 14/729,259, filed on Jun. 3, 2015, now abandoned.

(60) Provisional application No. 62/007,264, filed on Jun. 3, 2014.

(51) Int. Cl.

| | |
|---|---|
| ***B25G 1/02*** | (2006.01) |
| ***A61J 9/06*** | (2006.01) |
| ***A47G 21/08*** | (2006.01) |

(52) U.S. Cl.
CPC ..... *B25G 1/02* (2013.01); *A47G 21/08* (2013.01); *A61J 9/0623* (2015.05)

(58) Field of Classification Search
CPC ..... B25G 1/02; A61J 9/0623; A47G 23/0241; A47G 23/0258; A47G 23/0266; A47G 23/0291; B65D 25/28
See application file for complete search history.

(56) References Cited

U.S. PATENT DOCUMENTS

| | | | | |
|---|---|---|---|---|
| 3,682,352 A * | 8/1972 | Doucette | ..... | B65D 25/2817 206/150 |
| 2014/0239656 A1* | 8/2014 | Hancey | ..... | A45F 5/10 294/170 |

* cited by examiner

*Primary Examiner* — Emily Morgan

(57) ABSTRACT

A device and method for providing assistance in gripping items that is sanitary and flexible. In its simplest embodiment, the device is an elongated elastomeric piece with two ends, each end terminating in an enclosed aperture that can be attached to a device to be gripped. Alternate embodiments include an embodiment with a third hole for thumb assistance from the other hand for placing the strap around the hand of the user and the item to be gripped, an embodiment with a middle hole thereby providing three holes wherein the center hole wraps around the center of a baby bottle while the two end holes wrap around the top and bottom of the baby bottle while providing space between the top and bottom holes for the baby's hands, an embodiment with a y-strap for gripping hand tools and an embodiment with a center long hole to allow for the bend in the knuckles of the hand of the user.

1 Claim, 13 Drawing Sheets

GRIP SUPPORT DEVICE AND METHOD OF USE

REFERENCE TO PRIOR APPLICATION

This application is a Continuation-In-Part of patent application Ser. No. 14/729,259, filed Jun. 3, 2015 entitled GRIP SUPPORT DEVICE AND METHOD OF USE by Kerry Mellin, Merrily Mellin and Wendy Mellin, assigned to Mellin Works, LLC which claims priority of the provisional patent application 62/007,264, filed Jun. 3, 2014 entitled GRIP ASSIST SUPPORT STRAP by Kerry Mellin, Merrily Mellin and Wendy Mellin.

BACKGROUND OF THE INVENTION

Field of the Invention

The field of this invention relates generally to the field of assistive devices and more particularly toward a simple, easy to use and easy to keep sanitary device and method for assisting persons who are unable to grip simple items due to disability and/or injury or anyone who wants an effortless grip.

Description of the Prior Art

There are many persons, who either through a medical condition or injury are moderately to severely incapacitated in their ability to grip items sufficiently to use said items. Some prior art methods of assisting such persons has included the use of straps to secure the user's hand to the device to be gripped. Such straps have typically included buckles, snaps, hook and loop and have been made of plastic, leather, neoprene, cloth or materials. Prior art devices have had some drawbacks, however. Those that require buckles, snaps, hook and loop or other mechanical affixing means include extra steps that are difficult for persons already afflicted with limited grip.

Furthermore, some prior art devices are made of material that is stiff and inflexible as well as difficult to keep clean, dry and bacteria free.

It is the object of the instant invention to provide a novel support device and method of use that overcomes the drawbacks of the prior art.

SUMMARY OF THE INVENTION

The basic embodiment of the present invention teaches a temporary, adjustable, one-piece molded grip assisting device for assisting users by stretching onto and around items to be gripped comprising: an elongated main body having a top, a bottom, a first end and a second end wherein said top and said bottom have a thickness between 3 and 10 mm; a first aperture proximate said first end wherein said first end is between 1.11 and 1.67 thicker than said elongated main body; a second aperture proximate said second end wherein said second end is between 1.11 and 1.67 thicker than said elongated main body; wherein said device is made from a material having a durometer between 15 and 30 Shore A; wherein said device has a tensile strength equal to or greater than 3 mPa; wherein said device has a percent elongation of 500 or more; and wherein said device is made of a tacky, quick-drying material.

An alternate embodiment of the present invention teaches a temporary, adjustable, one-piece molded grip assisting device for assisting in the gripping of items comprising: an elongated main body having a top, a bottom, a first end and a second end wherein said top and said bottom have a thickness between 3 and 10 mm; a first aperture proximate said first end wherein said first end is between 1.11 and 1.67 thicker than said elongated main body; a second aperture proximate said second end wherein said second end is between 1.11 and 1.67 thicker than said elongated main body; wherein said device is made from a material having a durometer between 15 and 30 Shore A; wherein said device has a tensile strength equal to or greater than 3 mPa; wherein said device has a percent elongation of 500 or more; a third aperture proximate said second aperture to enable assistance in attaching items to the user's hand or limbs by pulling said device onto said item wherein said third aperture is hooked by said user's said other hand by a finger or thumb and pulling said device over said item and; wherein said device is made of a flexible elastomeric material that is non-bacteria housing and has enough structural integrity to support said items without structural failure and; wherein said first aperture, second aperture and third apertures are substantially the same circular shape and located along said elongated main body in an array wherein each of said first, second and third apertures are separated by portions of said elongated main body.

An alternate embodiment of the present invention teaches a method for the assistance of gripping devices comprising the steps of: obtaining the item to be gripped; determining that said item to be gripped is a single elongated member with a first end and a second end; obtaining a temporary, adjustable one-piece molded grip assisting device, said grip assisting device further comprising: an elongated main body having a top, a bottom, a first end and a second end wherein said top and said bottom have a thickness between 3 and 10 mm; a first aperture proximate said first end wherein said first end is between 1.11 and 1.67 thicker than said elongated main body; a second aperture proximate said second end wherein said second end is between 1.11 and 1.67 thicker than said elongated main body; a third aperture proximate said second aperture to enable assistance in attaching items to the user's hand or limbs by pulling said device onto said item wherein said third aperture is hooked by said user's said other hand by a finger or thumb and pulling said device over said item and wherein said device is made of a flexible elastomeric material that is non-bacteria housing and has enough structural integrity to support said items without structural failure and; wherein device is made from a material having a durometer between 15 and 30 Shore A; wherein said device has a tensile strength equal to or greater than 3 mPa; wherein said device has a percent elongation of 500 or more; wherein said first aperture, second aperture and third apertures are substantially the same circular shape and located along said elongated main body in an array wherein each of said first, second and third apertures are separated by portions of said elongated main body; stretching said first aperture proximate said first end around said first end of said item to be gripped; gripping said third aperture with said user's other hand and pulling said elongated main body over said item and stretching said second aperture proximate said second end around said first end of said item to be gripped thereby creating an open space between said first aperture proximate said first end, said second aperture proximate said second end and said item to be gripped; inserting a part of the user's body, such as the hand, fingers, wrist, lower or upper arm into said open space; and manipulating of said item to be gripped.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF A PREFERRED EMBODIMENT

Figure 1:
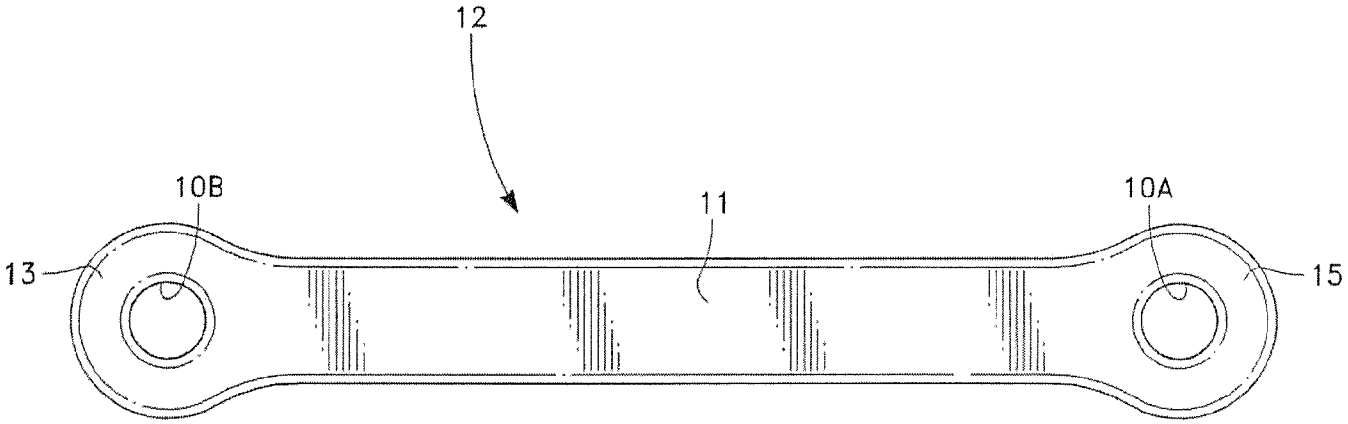
FIG. 1 is a top plan view of the basic embodiment of the instant invention.

Turning to the drawings, the preferred embodiment is illustrated and described by reference characters that denote similar elements throughout the several views of the instant invention.

The preferred embodiment provides for a simple device and method of use wherein there is a flexible, somewhat tacky strap with two or more apertures for attachment to an object to be gripped by a human hand or limb that is incapable due to a medial condition, disability, dismemberment or injury of gripping the item adequately for use. The strap is designed to be attached to the tool to be gripped and create a support for the hand, fingers or limb to relieve the stress and fatigue associated with the specific medical condition or injury.

The instant invention can be beneficial for people without grip issues at all, but who would like more control of objects while working, doing daily tasks or at play. It is particularly beneficial in use around water activities where a dry, non-slippery grip is necessary. These activities can include fishing, boating, water sports, hockey and skiing. Furthermore, the instant invention can be used for building and construction uses on ladders where "no drop tools" may be needed. These include hammers, wrenches, paint rollers, pick axes, shovels, etc.

Because the device is made from an elastomeric material, it will not harbor bacteria like other assistive devices made from cloth, hook and loop systems, leather and the like. The device of the instant invention can be disinfected and washed at high temperatures. For situations where tools and utensils must be washed and dried often, it can be especially beneficial. In particular, this invention works well for the use with standard or electric toothbrushes.

The device is composed of a flexible, stretchable, soft yet strong material such as silicone, latex or rubber. The device is a one piece molded item that has at least two holes, one at either end of the device. The flexibility and stretchability of the material from which the device is fabricated is superior to prior art devices because of its flexibility. The material used has a tensile strength equal to or greater than 3 mPa and its elongation percentage is equally to or greater than 500%. Its durometer makes it soft yet strong, i.e., in the range of 15-30 A, ideally 20+/−5. The durometer can be modified for specific uses and need not necessarily fall within this range. The material has self-stick, tacky properties so that when it is placed on the tool gripping portion it will more easily stay in place on the tool.

The construction of the strap 12 is unique in that the middle portion 11 is thinner than the end portions 13, 15 where the apertures 10A, 10B are located. This allows the device 12 to be able to twist and stretch and not break. The ratio of the middle portion 11 to the end portions 13, 15 is in the range of 0.6-0.9. Below is a table showing some examples of the ratio of thickness for varying embodiments of the strap 12.

| End thickness (mm) | Strap thickness (mm) |
|---|---|
| 8.5 | 6 |
| 9 | 6 |
| 10 | 7 |
| 5.5 | 3.5 |
| 8.5 | 5.5 |
| 7 | 5 |
| 5.5 | 4.5 |
| 7 | 6 |
| 8 | 5 |

Because it is made with a material with a soft and stretchy quality with high tensile strength relative to its stretchiness and durometer and because the end thickness 13, 15 is between 1.1 and 1.67 times thicker than the middle strip 11, it is able to fit and maintain its grip over a wide variety of implements and be adjusted as needed without losing its integrity, i.e., without breaking while still maintaining a tight grip. The device is comfortable on the hand or limb of the user because of its relatively soft durometer. It also easily washable compared to cloth, neoprene or leather and is therefore hygienic. Because the material it is made of, the device is quick drying. It is the first such device that has been approved for use in hospitals, therapy centers and schools because it is quick drying. More than being easily washable, it dries quickly enough to not cause hygiene issues. By contrast, cloth, neoprene and leather may be easily washable, but they are not quick drying. Because the device of instant invention dries quickly, it is effective in preventing contamination by bacteria whereas other materials would be susceptible to bacterial contamination. The device attaches to the implement to be gripped rather than the hand of the user and becomes a part of the device as long as it is in place. It is versatile in that it can be used on either hand. It can be used by persons without limited grip strength, limited hand or finger mobility or those with missing fingers but who wish to have grip assistance nonetheless. It doesn't even require fingers or hands as it can be used with the wrist and/or upper or lower arm. When attached to an implement it can also be used as a hanging storage device therefor.

The applications for use of the device are limited by the imagination of the user with regard to anything that requires gripping. Some examples include pens, styluses, multi-purpose tools, utensils, toys, sporting and aquatic equipment, musical instruments, household products, personal hygiene products, garden equipment, cleaning equipment, eating and cooking tools, paint brushes and painting equipment, therapeutic equipment, medical devices, bicycle handlebars, wheelchairs and other rehabilitation equipment. The device can be used for people of any age, from babies to the elderly.

Figure 2:
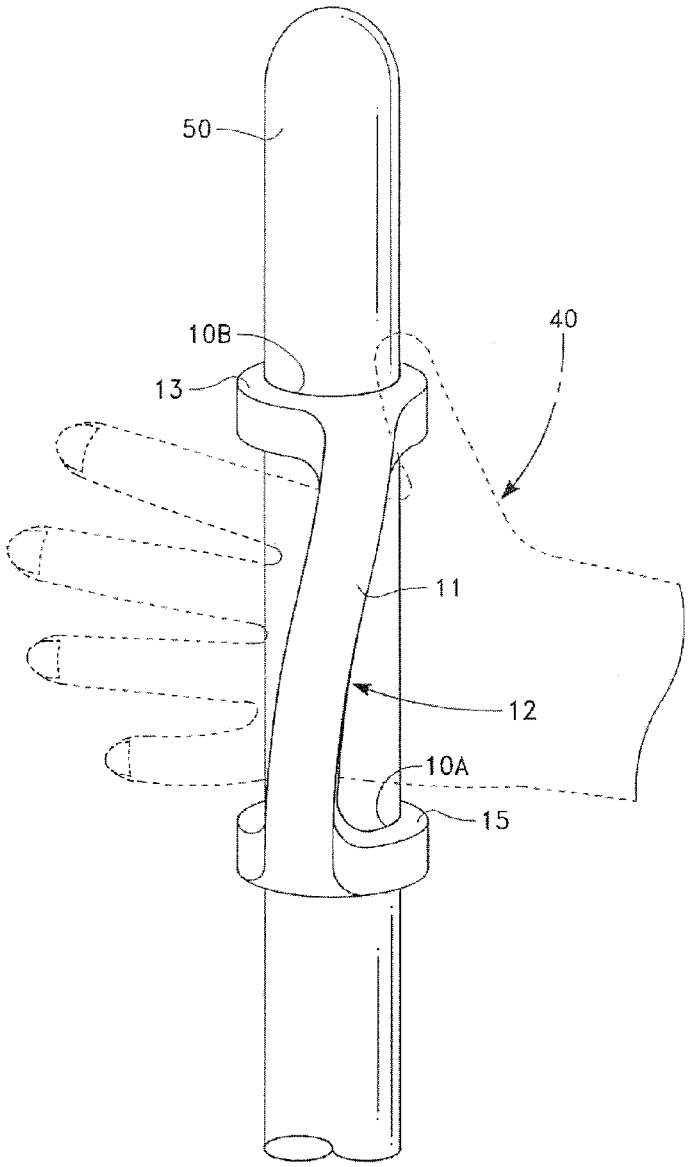
FIG. 2 is the top view of a hand with the basic embodiment of the instant invention wrapped around said hand and attached to a handle to be gripped.

Turning to FIG. 1, it is showing the basic embodiment of the instant invention. The device is a strap 12 having an elongated and stretchy main portion 11 that terminates in a first end 13 and a second end 15. The first end 13 has a first hole 10B and at the second end 15 has a second hole 10A. The device 12 in use is shown in its basic embodiment in FIG. 2. In this example, the hand 40 of the user is seeking to grip a broom handle 50. The first hole 10A on the first end 15 is placed over the broom handle 50 followed by the second hole 10B on the second end 13 leaving the elongated main portion 11 creating a space through which the hand 40 of the user can slide to effectively grip the broom handle 50.

Figure 3:
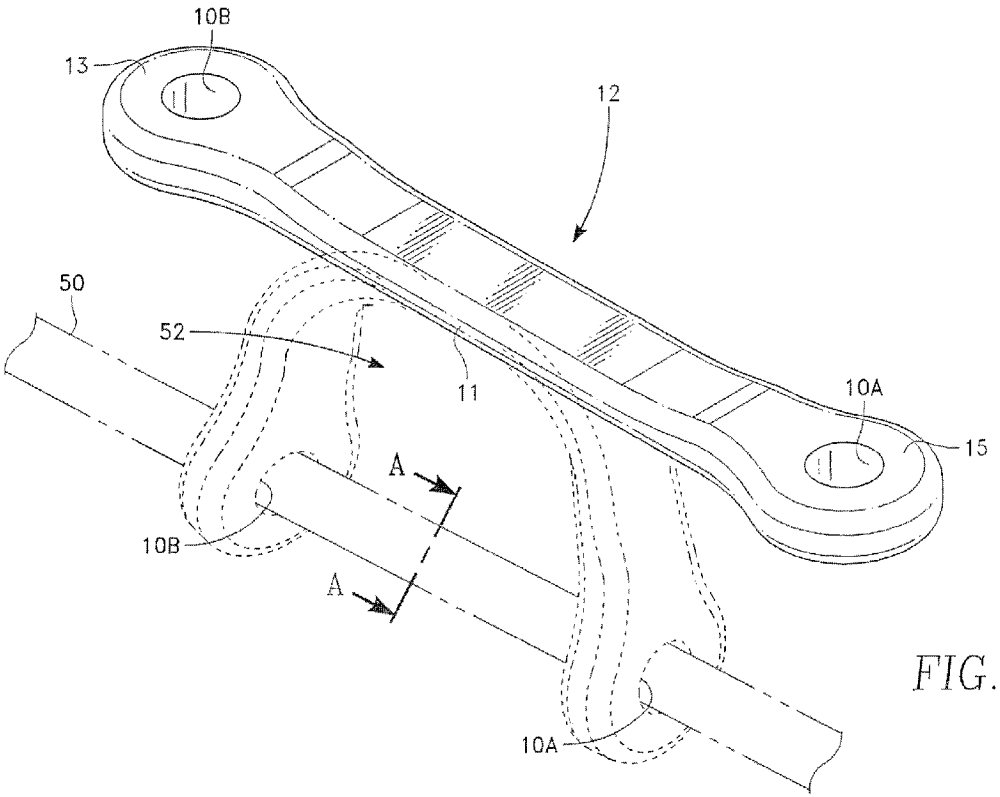
FIG. 3 is a perspective view of the device of the instant invention attached to a handle shown in phantom in the attached position.

FIG. 3 shows the basic embodiment of the device 12 as it is strapped to a general gripping handle 50 of any device that requires same. In this figure, the device 12 is shown in phantom in the gripping position with the area marked A-A indicating that the device 12 can be moved into any position 360 degrees relative to the handle 50. The area that is left under the elongated portion 11 can be adjusted to fit the hand 40 of the user.

Alternate embodiments can include the use of multiple auxiliary apertures on the support strap to adjust to different hand sizes. The apertures may be of different shapes and sizes. For example, some shapes could be, but are not limited to a teardrop shape, a keyhole shape, a circular shape or a buttonhole shape. The strap length, width and girth may be of varying sizes. The strap may be constructed with varying shapes and curves. The strap may have designs, textures or patterns printed thereon and may be engraved, embossed or have other methods of decoration. The straps could be made any color.

Figure 4:
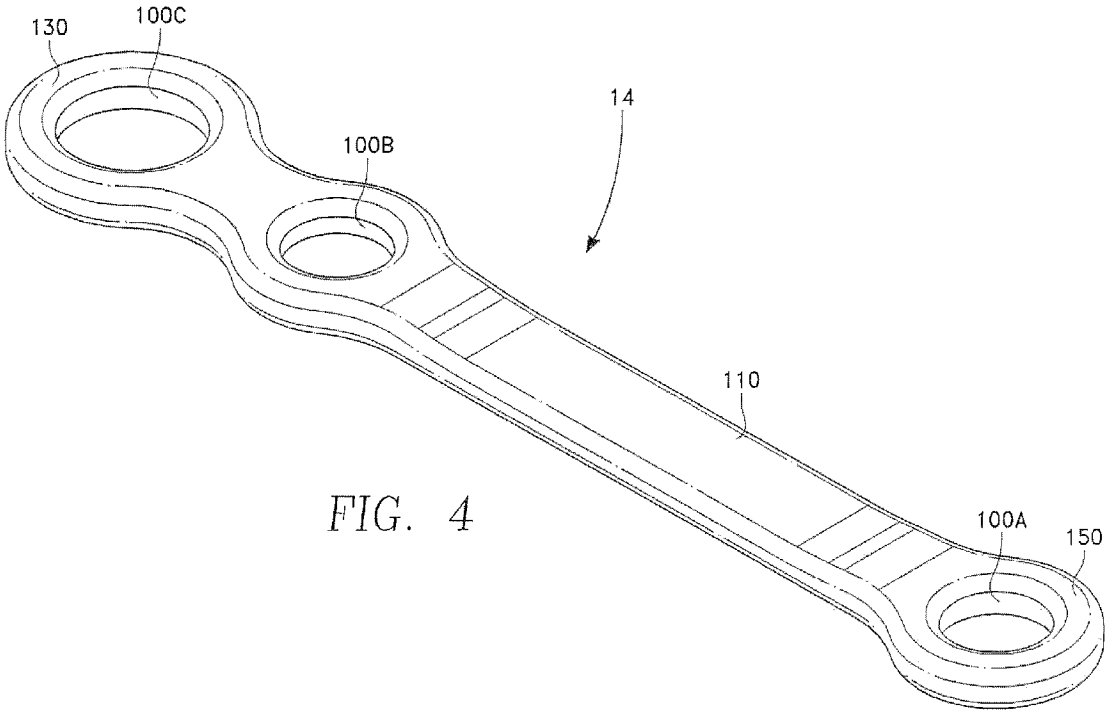
FIG. 4 is a perspective view of a thumb strap alternate embodiment of the instant invention wherein there is a third aperture for assistance in placing the strap onto an object.
Figure 4A:
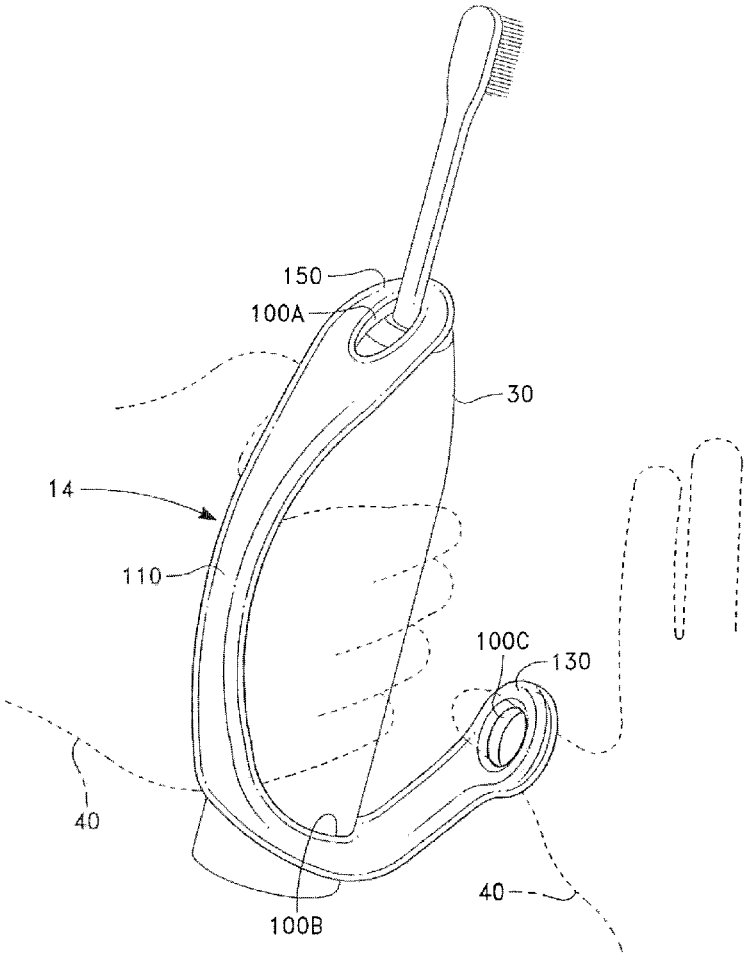
FIG. 4A shows the embodiment of FIG. 4 in use in placing the strap on an object.

Some alternate embodiments are illustrated in FIGS. 4-7A. In FIG. 4 the first alternate embodiment of the strap 14 has a first end 130 with a first hole 100C, a second end 150 with a second hole 100A and a third hole 100B at the end of the elongated portion 110 proximate the first hole 100C. This embodiment is shown in use in FIG. 4A. The second hole 100A operates as the end hole as in previous embodiments while the first hole 100C can be used as thumb leverage with the user's other hand 40 in order to assist in placing the device 14 onto the gripping object by person's with limited finger dexterity. The larger end hole 100C is a thumb hole to assist in placing the strap onto the object for those people who have no pinch grip to be able to maneuver the strap onto an object. They can hook it with their thumb for placement over the third hole 100B, then the thumb leaves the first hole 100C. In FIG. 4A the gripping object shown is an electric toothbrush 30.

Figure 5:
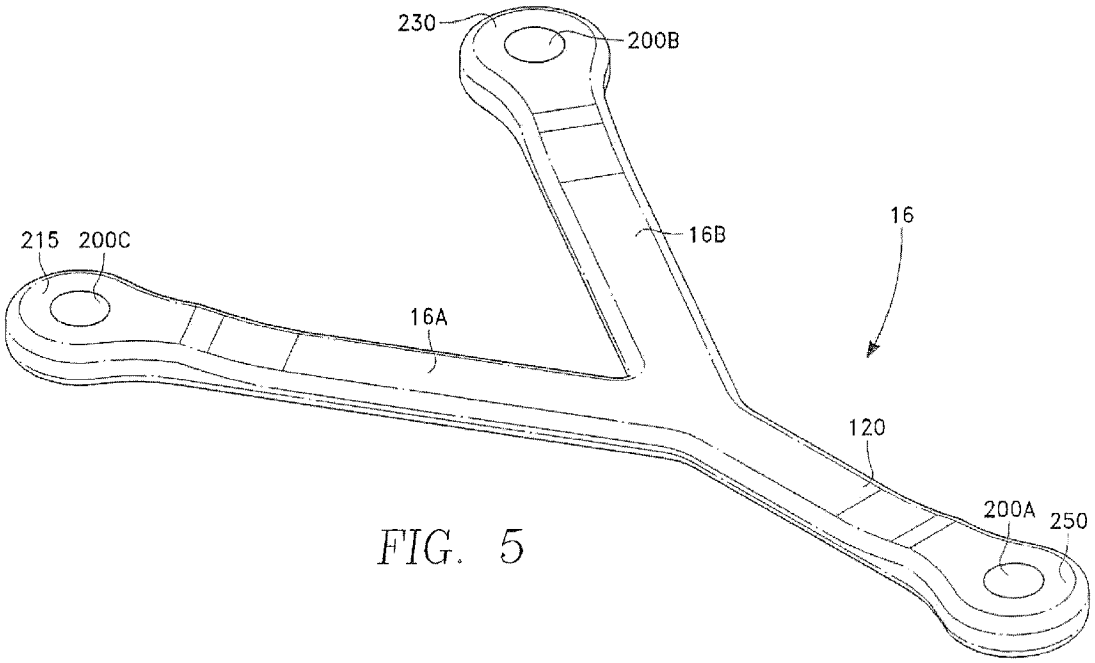
FIG. 5 is a perspective view of a y-strap second alternate embodiment of the instant invention wherein there is a third prong for attachment to an object.
Figure 5A:
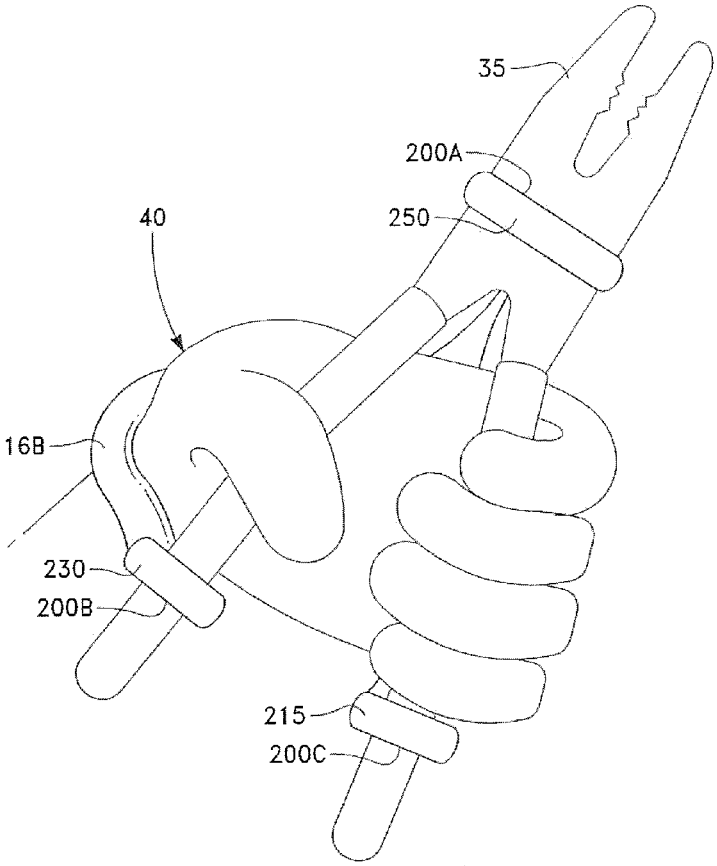
FIG. 5A shows the embodiment of FIG. 5 in use on a tool.

A second alternate embodiment is shown in FIGS. 5-5A. This embodiment of the device 16 includes a main elongated portion 120 and two more prongs 16A, 16B that make a Y-shape as they extend away from the main elongated portion 120. The main elongated portion 120 terminates in a first end 250 and a first hole 200A. The first prong 16A terminates in a second end 215 and second hole 200C. The second prong 16B terminates in a third end 230 and a third hole 200B. This embodiment allows for the attachment to items that require more than two attachment points, such as pliers 35 as shown in FIG. 5A.

In FIG. 5A, the strap 16 is seen wrapped at the first end 250 around the nose of the pliers 35 while the second end 215 wraps around one of the handles of the pliers 35 and the third end 230 wraps around the other handle of the pliers 35. The user's hand 40 grips the pliers 35 between the two prongs 16A, 16B.

Figure 6:
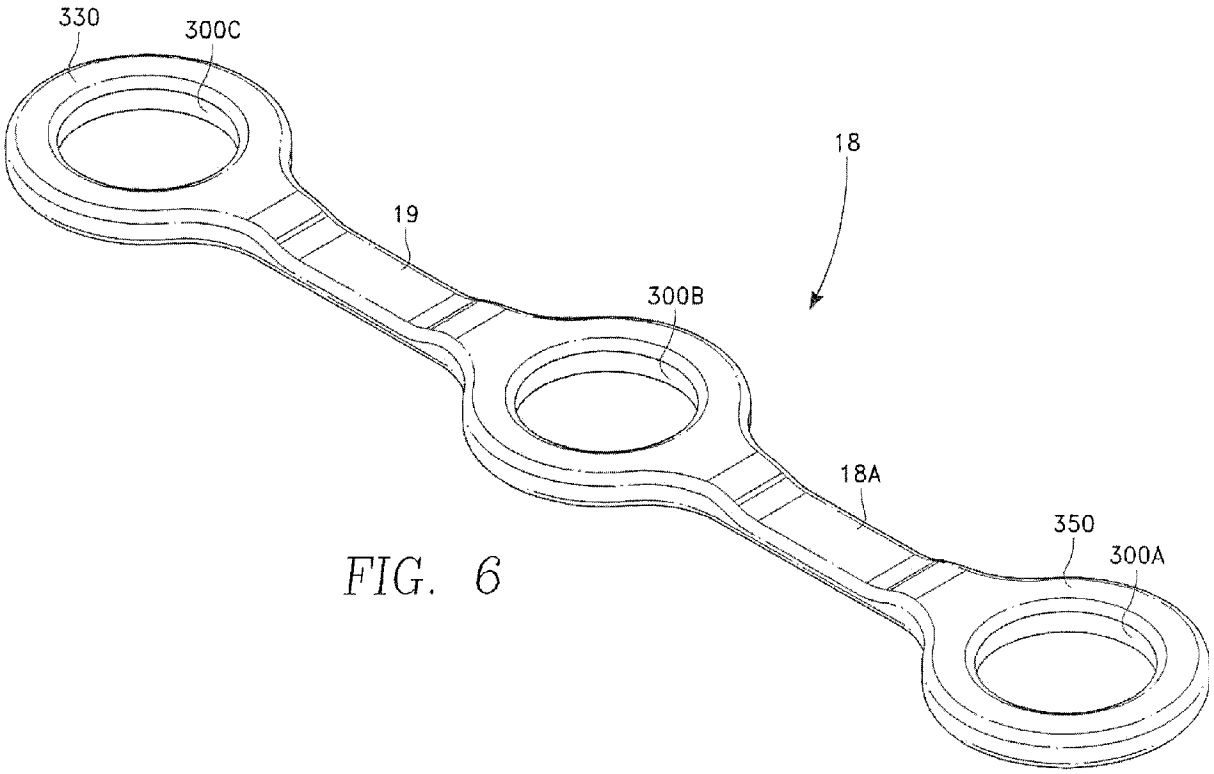
FIG. 6 is a perspective view of a third bottle strap alternate embodiment of the instant invention wherein there are three apertures set apart from each other wherein said apertures are larger than the prior embodiments.
Figure 6A:
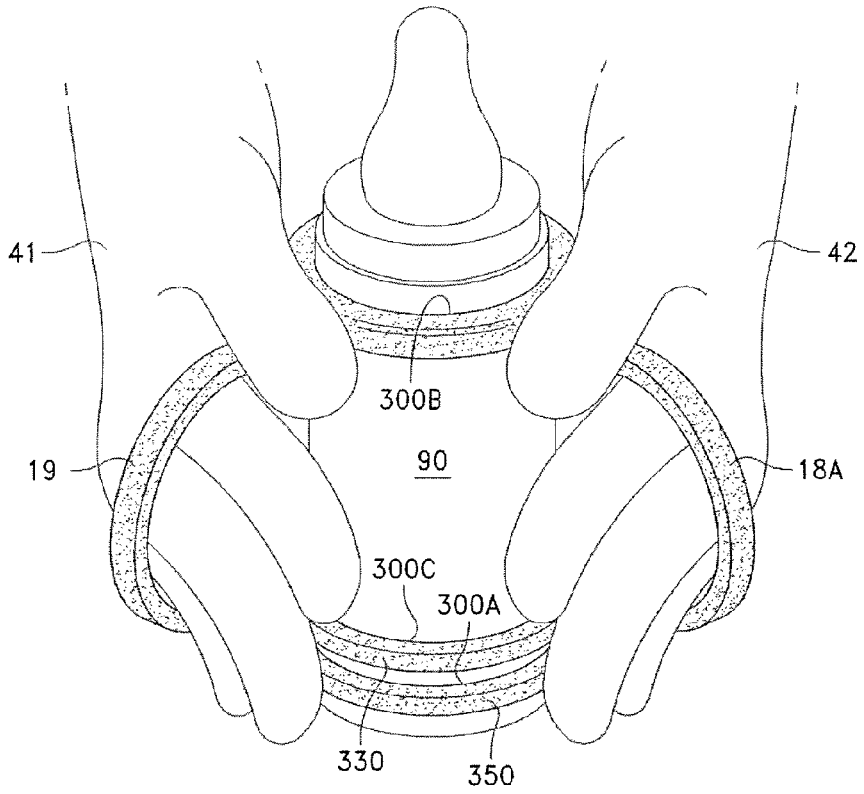
FIG. 6A shows the embodiment of FIG. 6 in use on a baby bottle.
Figure 6B:
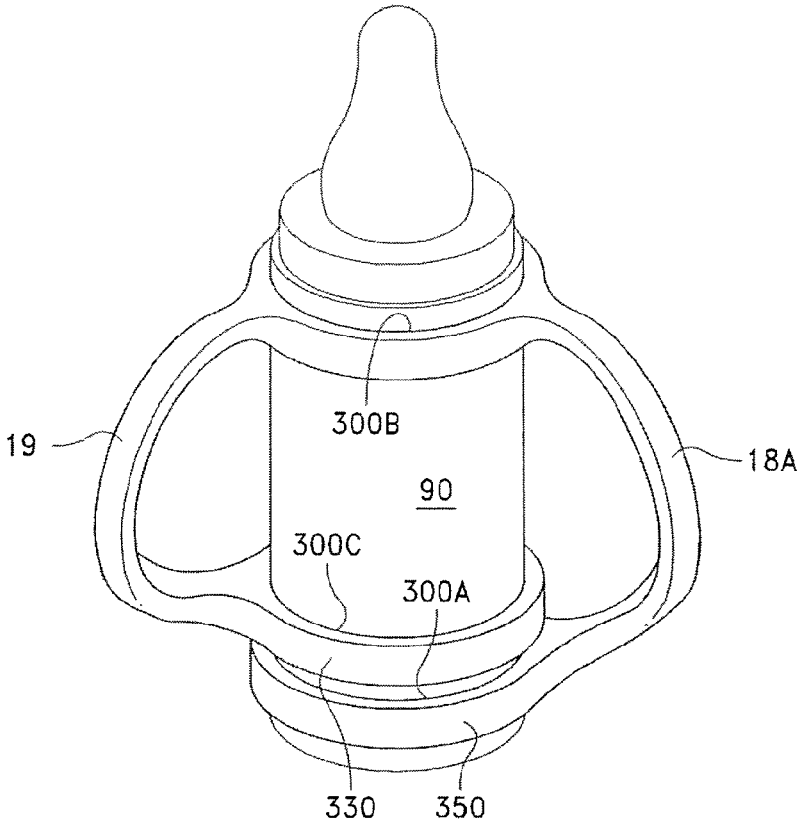
FIG. 6B shows the embodiment shown in FIG. 6A without the baby's hands being shown.

A third alternate embodiment of the device 18 is shown in FIG. 6. This embodiment 18 effectively has two elongated portions 18A, 19 separated by a hole 300B. Each elongated portion 18A, 19 has an end 350, 330 with each end 350, 330 having a correspondent hole 300A, 300C. This embodiment 18 illustrates apertures or holes 300A, 300B, 300C of equal size but this can be variable. This embodiment 18 is designed for use with assistance in gripping a baby bottle 90 as seen in FIGS. 6A-6B. In this embodiment, the center hole 300B wraps around the top of the baby bottle 90 while the first hole 300A and second hole 300C wrap around the bottom of the baby bottle 90. Each middle strap 18A, 19 wraps around each of one of the baby's hands 41, 42.

Figure 7:
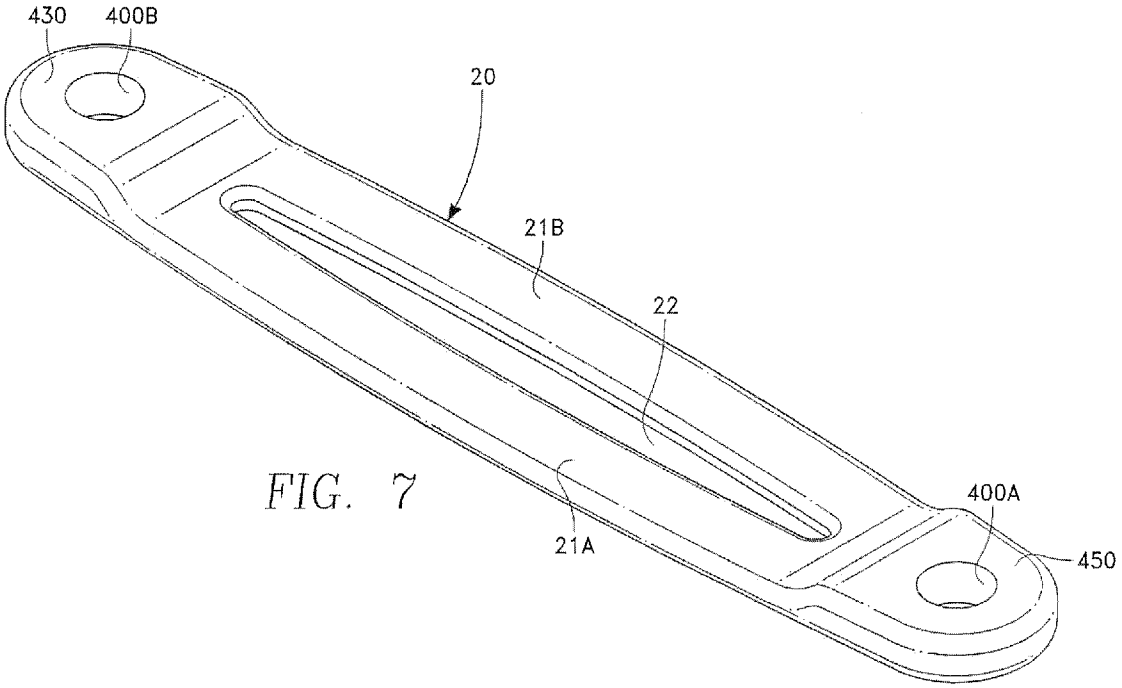
FIG. 7 is a perspective view of a fourth split-strap alternate embodiment of the instant invention wherein there is an elongated aperture along the length of the device for attachment to an object.
Figure 7A:
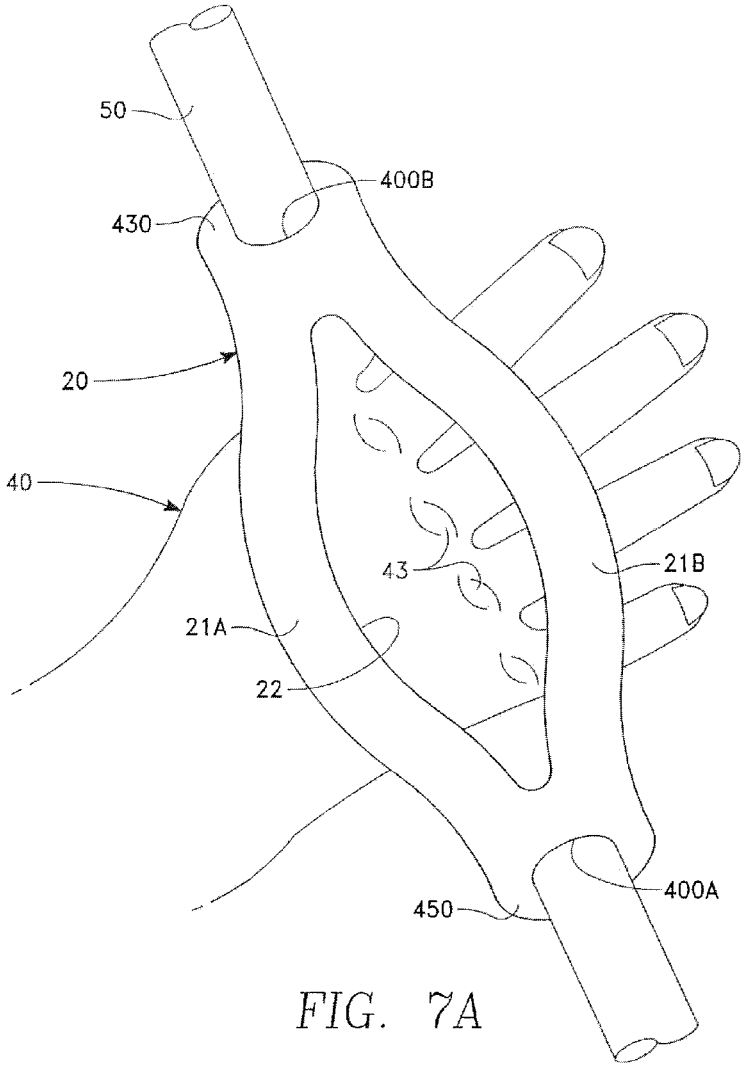
FIG. 7A shows the embodiment of FIG. 7 in use with the split allowing for the bending of knuckles.

A fourth alternate embodiment is shown in FIG. 7. In this embodiment of the device 20, there is a first end 430 with a first hole 400B and a second end 450 with a second hole 400A. The elongated portion is divided into two halves 21A, 21B with an elongated aperture 22 therebetween. This embodiment is designed to allow for the protrusion of the user's knuckle's 43 through the elongated aperture 22 when in use as seen in FIG. 7A. In FIG. 7A, the device 20 is wrapped at either end 430, 450 around the gripping device through the holes 400B, 400A. The user's hand 40 slips through the portion between the elongated portion 21A, 21B and when the hand forms a fist, the elongated aperture 22 allows for a split in the device 20.

Figure 8:
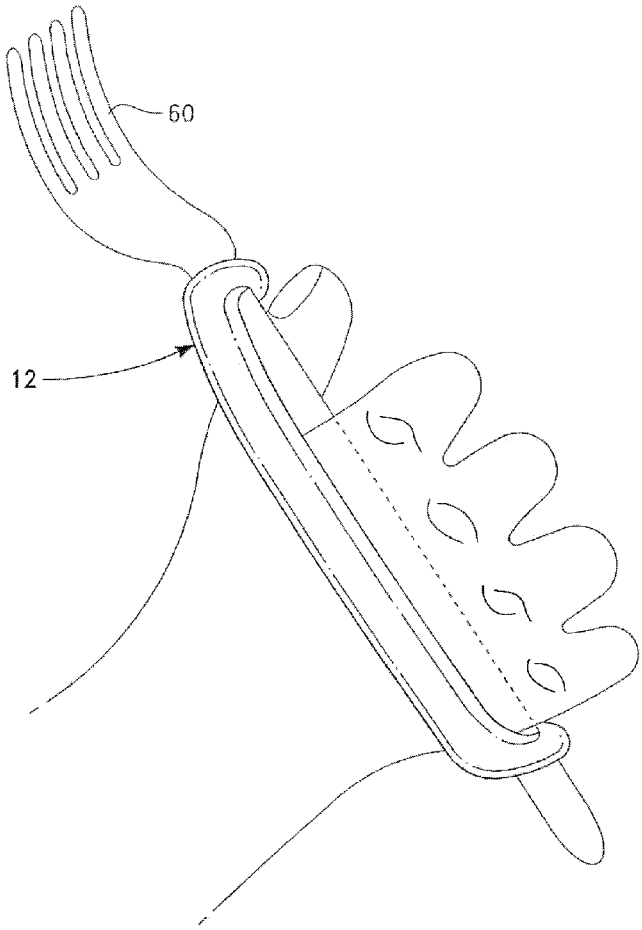
FIG. 8 shows the basic embodiment of the instant invention with and hand without fingers gripping a fork.

FIG. 8 illustrates how the basic embodiment 12 of the instant invention can be used to grip a fork 60 when the user has no fingers. When the user has no fingers, the gripping device 12 can go around the user's knuckles (as shown) as well as around the user's wrist or arm.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment, a method embodiment, or even merely a variation of any element of these. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. A method for the assistance of gripping devices comprising the steps of:

obtaining the item to be gripped;

determining that said item to be gripped is a single elongated member with a first end and a second end;

obtaining a grip assisting device, said grip assisting device further comprising:

an elongated main body having a top, a bottom, a first end and a second end wherein said top and said bottom have a thickness between 3 and 10 mm;

a first aperture proximate said first end wherein said first end is between 1.11 and 1.67 mm thicker than said elongated main body;

a second aperture proximate said second end wherein said second end is between 1.11 and 1.67 mm thicker than said elongated main body;

a third aperture proximate said second aperture to enable assistance in attaching items to the user's hand or limbs by pulling said device onto said item wherein said third aperture is hooked by said user's said other hand by a finger or thumb and pulling said device over said item and wherein said device is made of a flexible elastomeric material having a durometer between 15 and 30 Shore A and a tensile strength equal to or greater than 3 mPa;

wherein said device has a percent elongation of 500 or more;

wherein said first aperture, second aperture and third apertures are substantially the same circular shape and located along said elongated main body wherein each of said first, second and third apertures are separated by portions of said elongated main body;

stretching said first aperture proximate said first end around said first end of said item to be gripped;

gripping said third aperture with said user's other hand and pulling said elongated main body over said item and stretching said second aperture proximate said second end around said first end of said item to be gripped thereby creating an open space between said first aperture proximate said first end, said second aperture proximate said second end and said item to be gripped;

inserting a part of the user's body, such as the hand, fingers, wrist, lower or upper arm into said open space; and manipulating of said item to be gripped.

* * * * *